US005943015A

United States Patent [19]

Webb

[11] Patent Number: 5,943,015

[45] **Date of Patent: *Aug. 24, 1999**

[54] LAYERED ANTENNA

[75] Inventor: Roger Charles Webb, Paignton, United Kingdom

[73] Assignee: Northern Telecom Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/626,842

[22] Filed: Apr. 3, 1996

[30] Foreign Application Priority Data

Apr. 13, 1995 [GB] United Kingdom ..... 9507726

[51] Int. Cl.[6] ..... H01Q 1/38; H01Q 13/10

[52] U.S. Cl. ..... 343/700 MS; 343/770

[58] Field of Search ..... 343/700 MS, 767, 343/770, 846, 813, 815

[56] References Cited

U.S. PATENT DOCUMENTS

| | | | |
|---|---|---|---|
| 3,031,665 | 12/1962 | Marie | 343/770 |
| 3,165,743 | 1/1965 | Hatkin | 343/767 |
| 5,061,943 | 10/1991 | Rammos | 343/770 |
| 5,453,751 | 9/1995 | Tsukamoto et al. | 343/770 |
| 5,499,033 | 3/1996 | Smith | 343/700 MS |
| 5,559,523 | 9/1996 | Smith et al. | 343/815 |
| 5,563,613 | 10/1996 | Schroeder et al. | 343/770 |

*Primary Examiner*—Don Wong
*Assistant Examiner*—Tan Ho
*Attorney, Agent, or Firm*—Lee, Mann, Smith, McWilliams, Sweeny & Ohlson

[57] ABSTRACT

The present invention provides a layered antenna (otherwise known as a flat-plate antenna) having a number of radiating elements (201), each radiating element comprising a first substantially rectilinear aperture (210), having a first pair of oppositely directed probes (220,222) extending into an area defined by the aperture with secondary apertures (212,214) arranged coextensive with and on opposite sides of the primary aperture, adjacent said first pair of probes, said secondary apertures operable to modify the beamwidth in a plane coextensive with said first pair of probes. There is also provided a method of receiving and transmitting signals by means of a layered antenna of this construction.

11 Claims, 5 Drawing Sheets

LAYERED ANTENNA

FIELD OF THE INVENTION

This invention relates to layered antennas and in particular relates to beamwidth control means for such.

BACKGROUND TO THE INVENTION

Layered antennas, also known as flat plate antennas comprise a ground plane having an aperture or an array of apertures, a dielectric spacer, a feed probe network (typically copper tracks printed on a thin dielectric such as polyester) a second dielectric spacer and a second apertured ground plane.

Such an antenna is known from GB 2261554 (Northern Telecom). The ground planes may be shaped about an axis of the apertures to improve azimuth beamwidth GB 95 02528.4 (Northern Telecom). The array may be dual polarised, with e.g. a first set of feed probes in a vertical direction and with a second set of feed probes perpendicular to the first set of feed probes. Advantageously the dual polarised arrangement is defined by two layered antennas separated by a common ground plane, to reduce coupling between the polarisations.

A particular problem encountered with dual-polarised linear array antennas is that the azimuthal beamwidth of the two polarisations is dissimilar. Typically the axis of the array is arranged in a vertical orientation and the height and power of the array determine the size of each aperture. Such an optimum will have an azimuthal beamwidth of e.g. 75°–90°. Ideally the beamwidth of the two polarisation overlap. Under such circumstances, however, the edge portions of the ground plane—which cover the feed network for the probes—modify the beamwidth to e.g. 60° resulting in a requirement for either a) more vertical arrays or b) a modification of the width of each aperture so that it is unacceptably wide.

The present invention seeks to provide an antenna which overcomes or reduces the aforementioned problems.

SUMMARY OF THE INVENTION

In accordance with the present invention there is provided a layered antenna comprising a first aperture having a first pair of oppositely directed probes extending into an area defined by the aperture and operable to provide a beam, characterised in that secondary apertures are arranged coextensive with and on opposite sides of the aperture adjacent said first pair of probes, said secondary apertures operable to modify the beamwidth in a plane coextensive with said first pair of probes.

In accordance with another aspect of the invention there is provided a layered antenna having a linear array of radiating elements each radiating element comprising an antenna with a first substantially rectilinear aperture having a first pair of oppositely directed probes extending into an area defined by the aperture and operable to provide a beam, wherein secondary apertures are arranged coextensive with and on opposite sides of the aperture adjacent said first pair of probes, wherein the first apertures of each element define an array axis and wherein the secondary apertures are operable to modify the beamwidth in a direction perpendicular to said axis.

Preferably a reflecting backplane is situated behind the probes, the antenna may be provided with a second set of probes which extend into the first aperture in a direction perpendicular to the first set of probes operable in a second mode of polarisation. Further probes may extend into the secondary apertures.

The layered antenna can comprise a single radiating element having a first substantially rectilinear aperture with a first pair of oppositely directed probes extending into an area defined by the aperture, secondary apertures being arranged coextensive with and either side of the first aperture, operable to modify the beamwidth in a direction perpendicular to said axis.

There is also provided a method of receiving and transmitting signals by means of a layered antenna wherein the method comprises the steps of distributing such signals between a plurality of radiating elements provided by such antenna, with opposed portions of the radiating elements being arranged about an axis common to such opposed portions, and distributing the signals between such opposed portions such that the secondary apertures determine or help to determine the beam width or shape of the radiation pattern of the antenna in azimuth.

BRIEF DESCRIPTION OF THE DRAWINGS

In order that the invention may be understood, reference shall now be made to the Figures wherein.

DETAILED DESCRIPTION OF PREFERRED EMBODIMENTS

Figure 1:
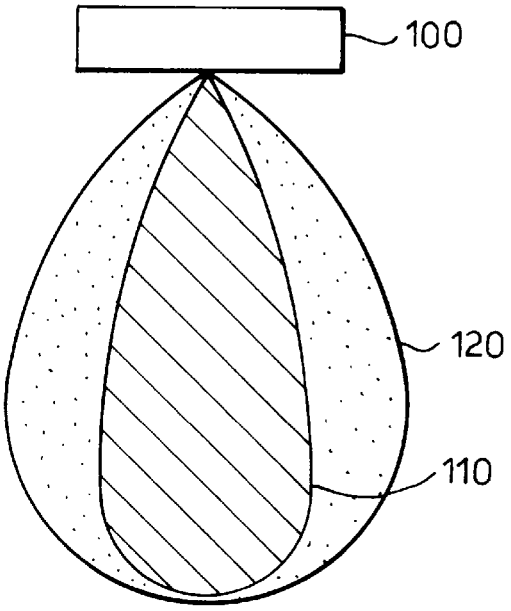
FIG. 1 shows a typical beam pattern in horizontal section of a prior art dual polarised antenna.

FIG. 1 shows a typical azimuthal beam pattern as provided by a known dual polarised antenna 10. The azimuthal beam pattern determined by the vertically oriented probes provides a narrower angular beam coverage 110 than the angular beam coverage 120 determined by the horizontally oriented probes.

Figure 2:
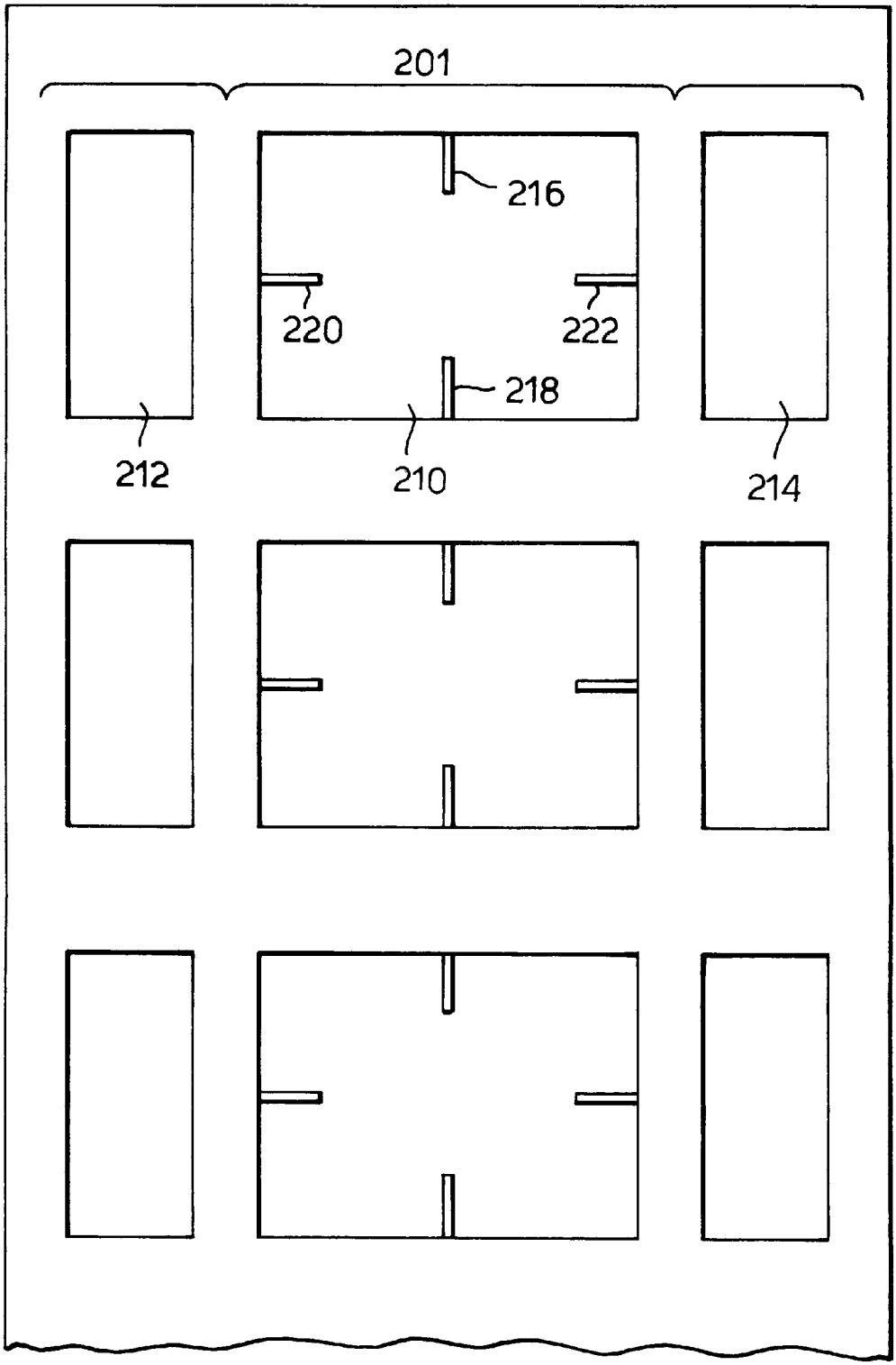
FIG. 2 shows a plan view of a first embodiment of the invention.

FIG. 2 shows a four element vertically oriented layered antenna array 200 wherein each element 201 comprises a central rectangular aperture 210 having both horizontally and vertically arranged probes. Either side of the central aperture 210 there are further apertures 212, 214. Vertical probes 216, 218 determine the vertical polarisation beam shape and horizontal probes 220, 222 in conjunction with aperture 212, 214 determine the horizontal polarisation beam shape.

Figure 3:
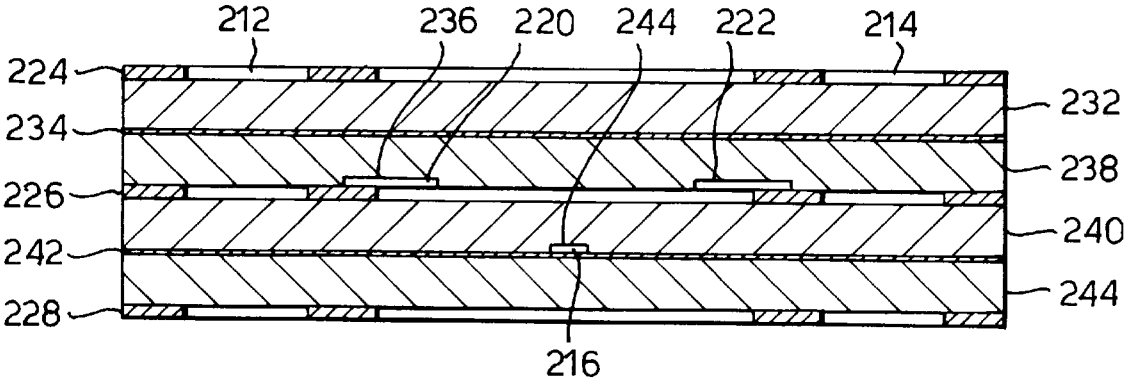
FIG. 3 shows a section through the dual polarised layered antenna shown in FIG. 2.

FIG. 3 shows a cross-section through the dual polarised array; the apertures 212, 214 extend through all ground planes 224, 226, 228. Between ground planes 224 and 226 and ground planes 226 and 228 are positioned first dielectric spaces 232, 240, dielectric films 234, 242 and second dielectric spaces 238, 246. Dielectric films 234, 242 have feed circuits 236, 244 printed thereon. In the case of a single polarisation antenna being employed, then ground plane 228, dielectric spacers 240, 246 and dielectric film 242 are not required.

It is believed that surface currents acting in the ground plane about the horizontal probes 220, 222 are directed by the side aperture 212, 214 and this has the effect of modifying the horizontal beamwidth. The side apertures may extend an equal distance in the vertical direction as the central aperture but this is not mandatory.

Figure 4:
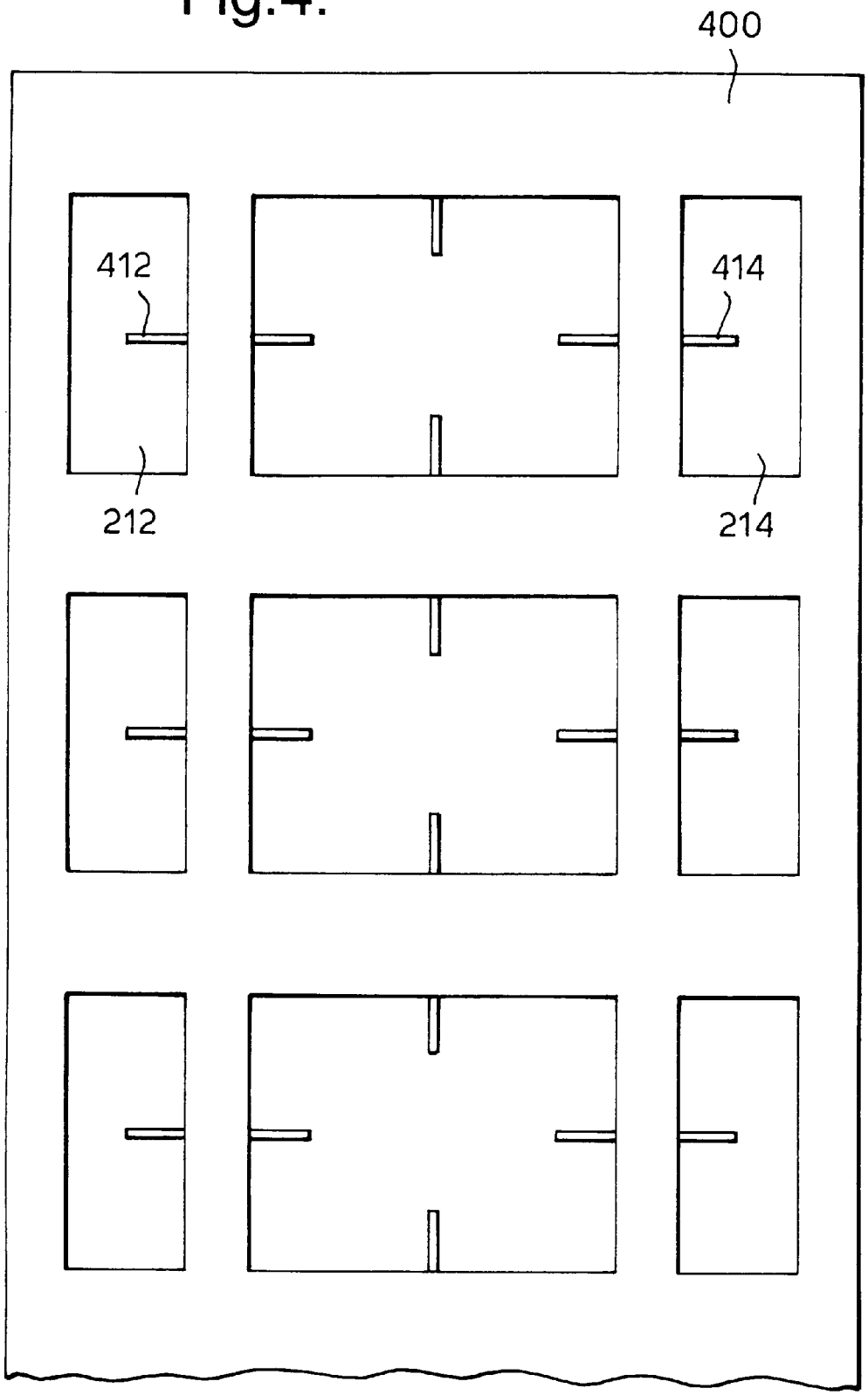
FIG. 4 shows a second embodiment of the invention.

FIG. 4 shows a variant of the invention wherein additional horizontal probes 412, 414 are provided in the side apertures 212, 214. These additional feed probes can conveniently be arranged on a dielectric film with the feed circuit being shielded by the ground plane between the two apertures.

Figure 5:
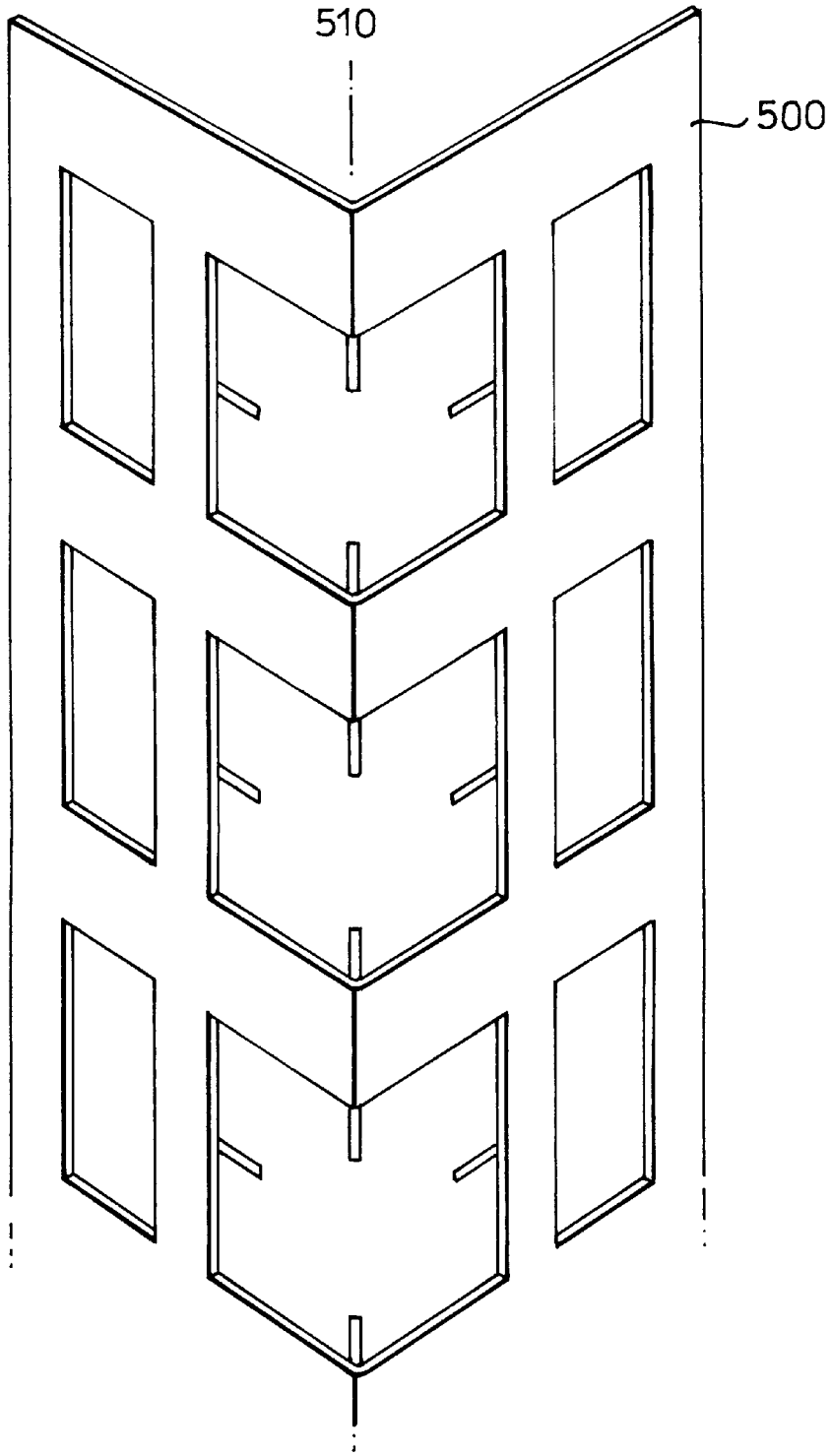
FIG. 5 shows a third embodiment of the invention.

FIG. 5 shows a further variant of the invention wherein the antenna 500 is formed about a vertical axis 510. Such a feature or bend in the plane can broaden the vertical beamwidth pattern of the antenna.

Figure 6:
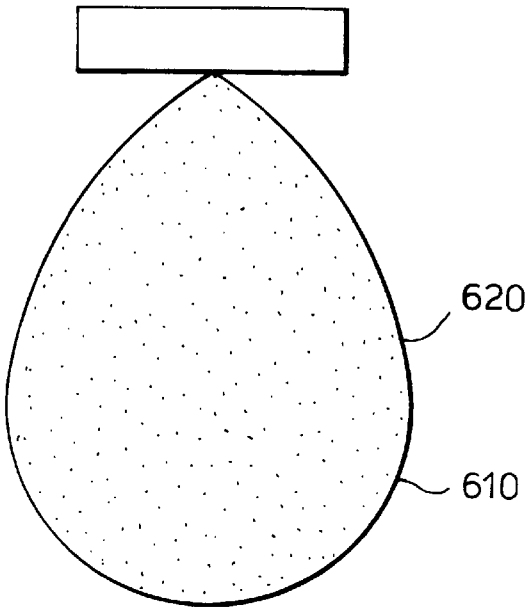
FIG. 6 shows a typical beam pattern in horizontal section as produced by a dual polarised antenna made in accordance with the present invention.

FIG. 6 shows an azimuthal cross section of a beam formed by an antenna made in accordance with the present invention wherein the antenna provides a dual polarised beam shape having the vertical beam shape 610 correspond with the horizontal beam shape 620 in the same plane.

Figure 7:
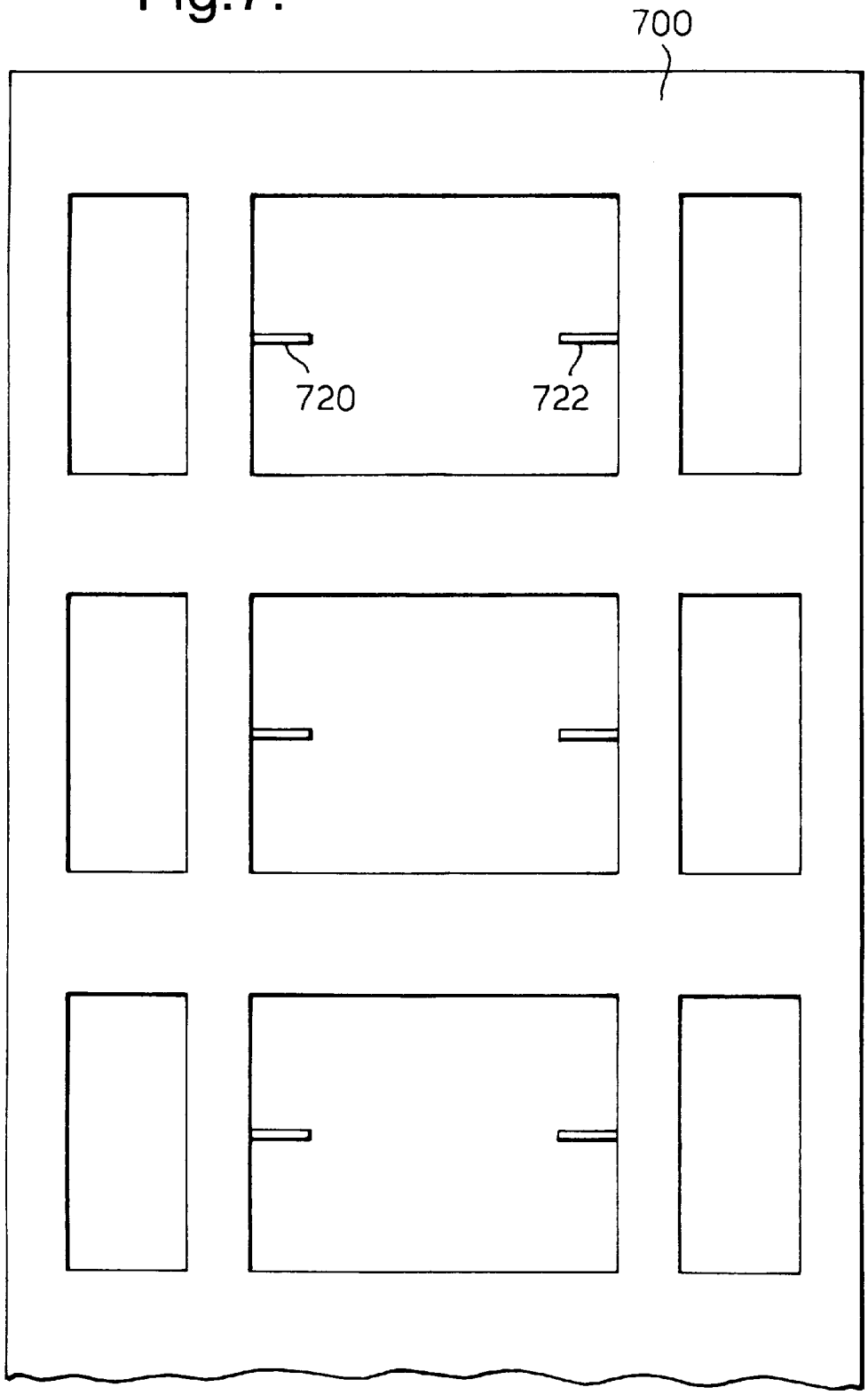
FIG. 7 shows a further embodiment of the invention.

FIG. 7 shows a two element layered array antenna 700 wherein only horizontal polarisation feed probes 720, 722 are provided: the beam shape has a greater angular coverage than an equivalent array having only a single aperture provided with feed elements.

I claim:

1. A single row layered antenna radiating element comprising a first aperture in a ground plane having a first pair of oppositely directed horizontal probes 220, 222 extending into an area defined by the aperture and operable to provide a horizontal polarised beam, and in which secondary apertures are arranged on opposite sides of the first aperture coextensive with said first aperture, said first and secondary apertures defining a linear element axis and said secondary apertures being arranged to modify a beamwidth in a primary radiating direction perpendicular to said linear element axis for said horizontally polarised beam.

2. A linear array of radiating elements, each radiating element comprising an antenna according to claim 1 wherein the first apertures of each element are arranged in an array to define an array axis, which array axis is perpendicular to the linear element axis.

3. A layered antenna according to claim 1 wherein a reflecting backplane is situated behind the probes.

4. A layered antenna according to claim 1 wherein the antenna comprises a first apertured groundplane, a first dielectric spacer, a dielectric film having a feed circuit printed thereon, a second dielectric spacer and a second groundplane.

5. A single row layered antenna radiating element comprising a first aperture in a ground plane having a first pair of oppositely directed horizontal probes 220, 222 extending into an area defined by the aperture and operable to provide a horizontally polarised beam, wherein secondary apertures are arranged on opposite sides of the first aperture coextensive with said first aperture, said first secondary apertures defining a linear element axis and said secondary apertures being arranged to modify a beamwidth in a primary radiating direction perpendicular to said linear element axis for said horizontally polarised beam, further comprising a further set of probes which extend into the secondary apertures.

6. A linear array of radiating elements, each radiating element comprising an antenna according to claim 5 wherein the first apertures of each element are arranged in an array to define an array axis, which array axis is perpendicular to the linear element axis.

7. A layered antenna radiating element comprising a first aperture in a ground plane having a first pair of oppositely directed probes extending into an area defined by the aperture and operable to provide a beam, said probes defining a longitudinal axis, wherein secondary apertures are arranged on opposite sides of said longitudinal axis coextensive with said first aperture, said secondary apertures being arranged to modify the azimuth beamwidth, further comprising a second set of probes which extend into said first aperture in a direction perpendicular to said first pair of probes operable in a second mode of polarisation.

8. A layered antenna according to claim 7 wherein the antenna comprises a first apertured groundplane, a first dielectric spacer, a dielectric film having a feed circuit for a first polarisation printed thereon, a second dielectric spacer, a second apertured groundplane, a third dielectric spacer, a dielectric film having a feed circuit for a second polarisation printed thereon, a fourth dielectric spacer and a third ground plane.

9. A method of operating a single row layered antenna radiating element comprising a first aperture in a ground place having a first pair of oppositely directed horizontal probes 220, 222 extending into an area beam, wherein the secondary apertures are arranged on opposite sides of said first aperture coextensive with said first aperture, said first and secondary apertures defining a linear element axis, the method, in a transmit mode, comprising the steps of distributing transmit signals between the first pair of oppositely directed horizontal probes 220, 222 extending into the area defined by the aperture; and in a receive mode, comprising the step of receiving signals from the first pair of oppositely directed horizontal probes 220, 222 extending into the area defined by the aperture;

whereby the secondary apertures aid determination of a beam shape of a resulting radiation pattern of the antenna in a primary radiating direction perpendicular to said linear element axis for said horizontally polarised beam.

10. A method of operating a layered antenna array, each radiating element of the array comprising a single row of first and secondary apertures, wherein a first aperture in a ground plane includes a first pair of oppositely directed horizontal probes 220, 222 extending into an area defined by the aperture and operable to provide a horizontally polarised beam, wherein the secondary apertures are arranged on opposite sides of the first aperture coextensive with said first aperture coextensive with said first aperture, said first and secondary apertures defining a linear element axis, the method, in a transmit mode, comprising the steps of distributing transmit signals between the first pair of oppositely directed horizontal probes 220, 222 extending into the area defined by the first aperture of each element; and in a receive mode, comprising the step of receiving signals from the first pair of oppositely directed horizontal probes 220,222 extending into the area defined by the first aperture of each element;

whereby the secondary apertures aid determination of a beam shape of a resulting radiation pattern of the antenna in a primary radiating direction perpendicular to said linear element axis for said horizontally polarised beam.

11. A method of operating a single row layered antenna radiating element comprising a first aperture in a ground plane having first pair of oppositely directed horizontal probes 220,222 extending into an area defined by the aperture and operable to provide a horizontally polarised beam, where in the secondary apertures are arranged on opposite sides of the first aperture coextensive with said first aperture, said first and secondary apertures defining a linear element axis further comprising a further pair of horizontal probes 412, 414 which extend into the secondary apertures, the method, in a transmit mode, comprising the steps of distributing transmit signals between the first pair of oppositely directed horizontal probes 220, 222 extending into the area defined by the aperture and between the pair of horizontal probes 412, 414 which extend into the secondary apertures; and in a receive mode, comprising the step of receiving signals from the first pair of oppositely directed horizontal probes 220, 222 extending into the area defined by the aperture and between a pair of horizontal probes 412, 414 which extend into the secondary apertures;

whereby the secondary apertures aid determination of a beam shape of a resulting radiation pattern of the antenna in a primary radiating direction perpendicular to said linear element axis for said horizontally polarised beam.

* * * * *